US010006628B2

(12) United States Patent
Roy et al.

(10) Patent No.: US 10,006,628 B2
(45) Date of Patent: Jun. 26, 2018

(54) LOW $NO_x$ GAS BURNERS WITH CARRYOVER IGNITION

(75) Inventors: William J. Roy, Avon, IN (US); Scott A. Liljenberg, Wethersfield, CT (US)

(73) Assignee: CARRIER CORPORATION, Farmington, CT (US)

( * ) Notice: Subject to any disclaimer, the term of this patent is extended or adjusted under 35 U.S.C. 154(b) by 702 days.

(21) Appl. No.: 13/311,819

(22) Filed: Dec. 6, 2011

(65) Prior Publication Data

US 2012/0178032 A1 Jul. 12, 2012

Related U.S. Application Data

(60) Provisional application No. 61/431,252, filed on Jan. 10, 2011.

(51) Int. Cl.

| | |
|---|---|
| ***F23C 5/08*** | (2006.01) |
| ***F23D 14/58*** | (2006.01) |
| ***F23D 14/26*** | (2006.01) |

(52) U.S. Cl.

CPC ..... *F23D 14/58* (2013.01); *F23D 14/26* (2013.01); *F23D 2203/1017* (2013.01); *F23D 2205/00* (2013.01); *F23D 2207/00* (2013.01); *F23D 2213/00* (2013.01)

(58) Field of Classification Search

CPC . F23D 14/58; F23D 14/583; F23F 2203/1017
USPC ..... 431/178, 191, 192, 193, 283, 286, 354; 126/109, 116 R
See application file for complete search history.

(56) References Cited

U.S. PATENT DOCUMENTS

| | | | | |
|---|---|---|---|---|
| 2,533,143 | A * | 12/1950 | Scharbau et al. | 431/286 |
| 3,938,945 | A * | 2/1976 | Riehl | 431/191 |
| 4,660,761 | A | 4/1987 | Bussjager | |
| 4,887,959 | A | 12/1989 | Shellenberger | |
| 4,945,890 | A | 8/1990 | Ripka | |
| 5,035,609 | A | 7/1991 | Riehl | |
| 5,244,382 | A * | 9/1993 | Riehl | 431/286 |
| 5,458,484 | A * | 10/1995 | Ripka | F23D 14/58 126/109 |
| 5,649,529 | A | 7/1997 | Lu et al. | |
| 5,833,449 | A | 11/1998 | Knight et al. | |
| 6,109,254 | A | 8/2000 | Reinke et al. | |
| 6,655,373 | B1 | 12/2003 | Wiker | |

(Continued)

OTHER PUBLICATIONS

Gollahalli, S.R. "Jet Flames in noncircular burners". Sadhana, vol. 22, Part 3. Jun. 1997.*

*Primary Examiner* — Vivek Shirsat
(74) *Attorney, Agent, or Firm* — Cantor Colburn LLP

(57) ABSTRACT

A gas burner for low $NO_x$ gas furnaces is disclosed with improved flame carryover for igniting one or more adjacent burners. The burner includes a burner tube that receives a mixture of fuel and air. The burner tube is coupled to an outlet. The outlet includes a primary outlet opening which is in communication with at least one transverse slot for communicating a flame to at least one adjacent burner. The primary outlet opening may be elliptical and the outlet further may also include a concave outer face through which the primary outlet opening extends. The at least one slot may include a pair of oppositely directed transverse slots extending outward from the primary outlet opening along a semi-minor axis of the primary outlet opening.

8 Claims, 4 Drawing Sheets

(56) References Cited

U.S. PATENT DOCUMENTS

| | | | |
|---|---|---|---|
| 6,860,734 | B2 | 3/2005 | Zia |
| 6,880,548 | B2 | 4/2005 | Schultz et al. |
| 6,923,643 | B2 | 8/2005 | Schultz et al. |

* cited by examiner

LOW $NO_x$ GAS BURNERS WITH CARRYOVER IGNITION

CROSS-REFERENCE TO RELATED APPLICATIONS

This is a US patent application claiming priority under 35 USC § 119(e) to U.S. Provisional Patent Application Ser. No. 61/431,252 filed on Jan. 10, 2011.

BACKGROUND

Technical Field

This disclosure relates to gas burners in general, and more specifically, to gas burners of multi-burner applications where only one burner contains an igniter and the remaining burners must be lit from the single burner with the igniter using flame carryover. Still more specifically, this disclosure relates to improvements in flame carryover aspects of low $NO_x$ burners that reduce the gas used for flame carryover while still providing a robust ignition for all burners.

Description of the Related Art

During the combustion of natural gas, liquefied natural gas on propane, $NO_x$ is formed and emitted to the atmosphere with other combustion products. Because these fuels contain little or no fuel-bound nitrogen per se, $NO_x$ is largely formed as a consequence of oxygen and nitrogen in the air reacting at the high temperatures resulting from the combustion of the fuel.

Governmental agencies have passed legislation regulating the amount of $NO_x$ that may be admitted to the atmosphere by gas furnaces and other devices. For example, in certain areas of the United States, e.g., California, regulations limit the permissible emission of $NO_x$ from residential furnaces to less than 40 ng/J (nanograms of $NO_x$ per Joule of useful heat generated). Future regulations include plans to restrict $NO_x$ emissions from residential furnaces and boilers to less than 15 ng/J.

Gas furnaces often use a particular type of gas burner commonly referred to as an in-shot burner or two-stage burner. Such burners include a burner nozzle having an inlet at one end for receiving separate fuel and primary air streams and an outlet at the other end through which mixed fuel and primary air discharges from the burner nozzle in a generally downstream direction. Fuel gas under pressure passes through a central port disposed at or somewhat upstream of the inlet of the burner nozzle. The diameter of the inlet to the burner nozzle is larger than the diameter of the fuel inlet so as to form an annular area through which atmospheric air (a.k.a. primary air) is drawn into the burner nozzle about the incoming fuel gas.

The primary air mixes with the fuel gas as it passes through the tubular section of the burner nozzle to form a primary air/gas mix. This primary air/gas mix discharges from the burner nozzle and ignites as it exits the nozzle outlet section forming a flame projecting downstream from a flame front located immediately downstream of the burner nozzle outlet and spaced apart from an inlet of the primary heat exchanger. Secondary air flows around the outside of the burner nozzle and is entrained in the burning mixture downstream of the nozzle in order to provide additional air to support combustion as the burning mixture enters the heat exchanger inlet.

In-shot burner designs cannot meet the more stringent $NO_x$ emission requirements because of their reliance on secondary air to complete the combustion process. The mixing of air and fuel of such systems produced unacceptably high $NO_x$ emissions higher-than the future regulations. In order to comply, the current in-shot burner design is being replaced by burner designs where the air and fuel is fully premixed before combustion, without the use of secondary air. Instead of providing a gap between the burner and heat exchanger which allows for the entrainment of secondary air, the premixed burners are coupled to the heat exchanger inlet. By eliminating the use of secondary air, the premixing of the fuel and air can be controlled and a premixed, lean mixture may be used for combustion which produces less $NO_x$ than traditional in-shot burners.

In multi-burner applications such as a typical sectional gas furnaces each heat exchanger is supplied hot combustion products by individual burners. Typically only one burner contains an igniter and therefore, upon ignition, the remaining burners are lit from the single burner with the igniter. Flame carryover is the ability to transfer the flame from one burner to the next. The current industry standard "in-shot" burner uses a small channel between burners where a small flame transfers hot gases to light each successive burner as shown in FIG. 2. This carryover method has proven ineffective when used in combination with premix burners disposed immediately upstream of the heat exchanger.

SUMMARY OF THE DISCLOSURE

A gas burner for low $NO_x$ gas furnaces is disclosed with improved flame carryover for igniting one or more adjacent burners. The burner comprises a burner tube that receives a mixture of fuel and air. The burner tube is coupled to an outlet. The outlet includes a primary outlet opening which is in communication with at least one transverse slot for communicating a flame to at least one adjacent burner.

A burner assembly is also disclosed that comprises a plurality of burners. Each burner comprises a burner tube that receives a mixture of fuel and air. Each burner tube is coupled to an outlet. Each outlet comprises a primary outlet opening that is in communication with at least one transverse slot for communicating a flame to at least one adjacent burner.

A low $NO_x$ sectional furnace is also disclosed that comprises a burner assembly comprising a plurality of burners. Each burner comprises a burner tube that receives a mixture of fuel and air. Each burner tube is coupled to a primary outlet opening. Each primary outlet opening is in communication with at least one transverse slot for communicating a flame to at least one adjacent burner.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

DETAILED DESCRIPTION OF THE PRESENTLY PREFERRED EMBODIMENTS

Figure 1:
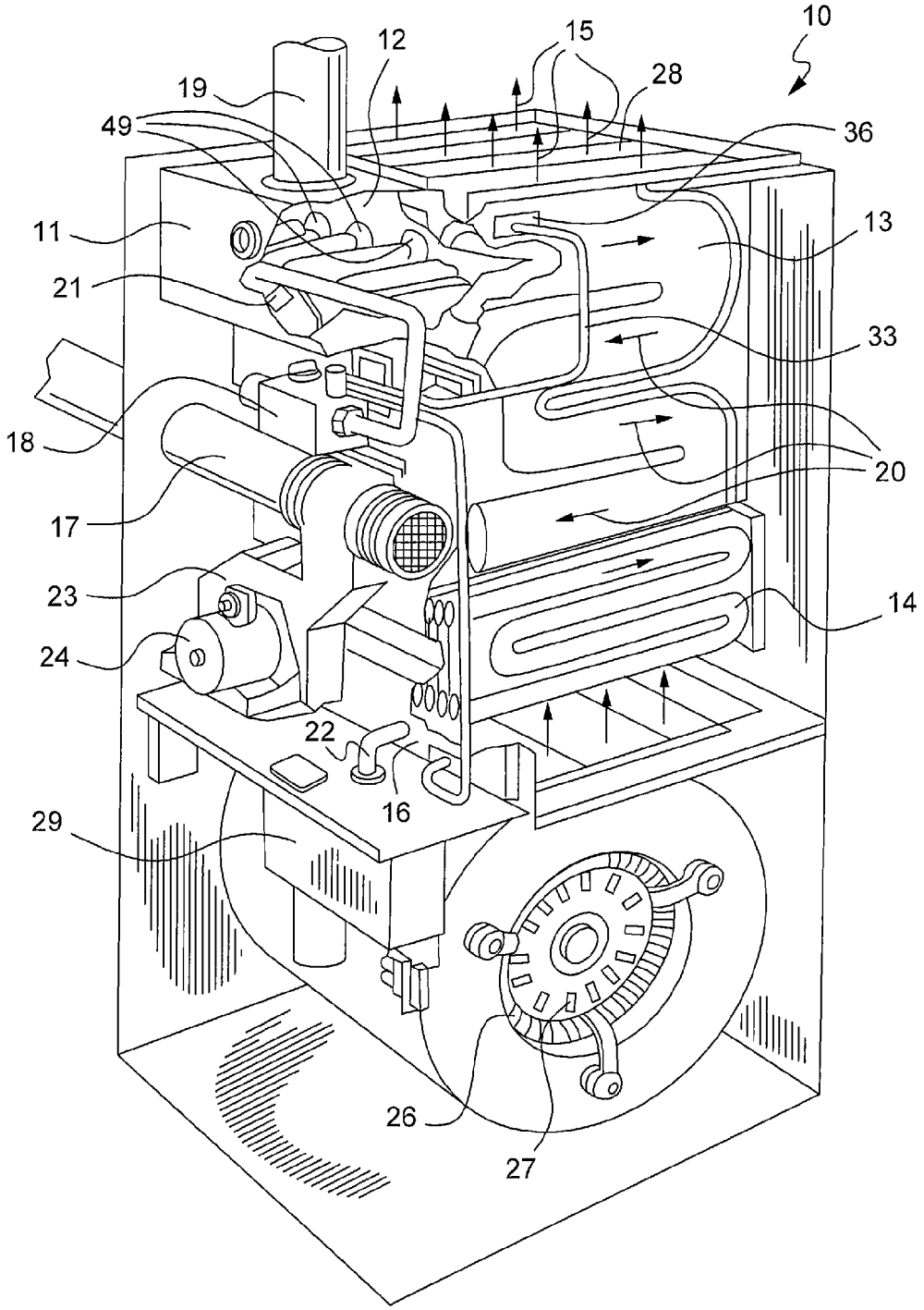
Fig. 1 (Prior Art)
FIG. 1 is a perspective view of a prior art sectional gas furnace.

Referring first to FIG. 1, a sectional gas furnace 10 is shown which comprises a burner assembly 11 with a burner box 12 that is decoupled from the inlets 49 of the primary heat exchanger sections, only one of which can be seen at 13. The primary heat exchanger sections 13 are in fluid communication with corresponding condensing heat exchanger sections 14 whose discharge end is fluidly connected to a collector box 16 and an exhaust vent 17. In operation, a gas valve 18 meters the flow of gas to the burner assembly 11 where combustion air from an air inlet 19 is mixed and ignited by an igniter assembly 21. The hot gas and secondary air are passed through the inlets 49 of the primary heat exchanger sections 13. The primary heat exchanger sections 13 lead to the condensing heat exchanger sections are 14, as shown by the arrows 20.

The relatively cool exhaust gases then pass through the collector box 16 and exhaust vent 17 before being vented to the atmosphere, while the condensate flows from the collector box 16 through a drain line 22 for disposal. Flow of combustion air into the air inlet through the heat exchanger sections 13, 14 and the exhaust vent 17 is controlled by an inducer fan 23. The inducer fan 23 is driven by a motor 24 in response to signals from the integrated furnace control or IFC 29. The household air is drawn into a blower 26 which is driven by a drive motor 27, in response to signals received from the IFC 29. The discharge air from the blower 26 passes over the condensing heat exchanger sections 14 and the primary heat exchanger sections 13, in a counter-flow relationship with the hot combustion gases to thereby heat the indoor air, which then flows from the discharge opening 28 in the upward direction as indicated by the arrows 15 to a duct system (not shown) within the space being heated.

Figure 2:
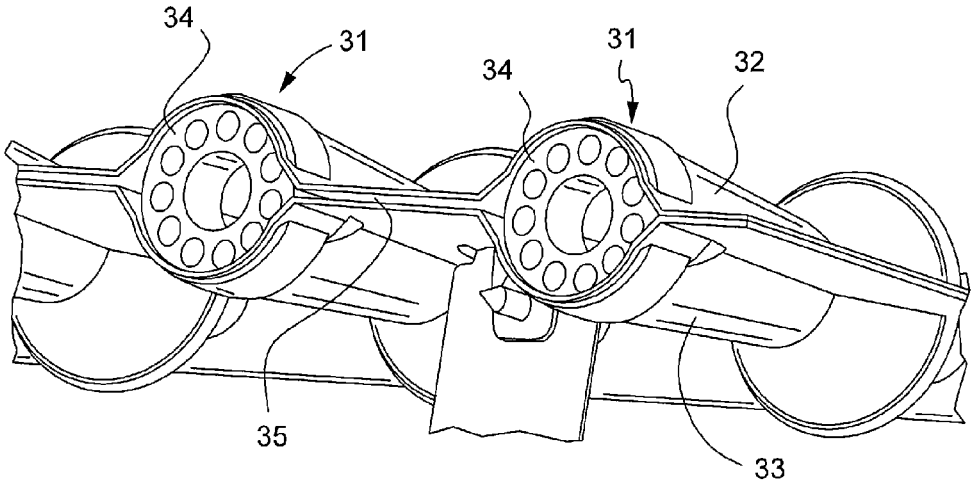
Fig. 2 (Prior Art)
FIG. 2 is a partial perspective view of a prior art in-shot burner assembly equipped with a flame carryover mechanism for use in a sectional gas furnace, like the furnace illustrated in FIG. 1.

Turning to FIG. 2, a pair of-shot burners 31 illustrated that are fabricated from two half shells 32, 33. The flame retention devices are illustrated at 34. The half shells 32, 33 provide for a convenient passageway 35 that can be used for flame carryover between the two burners 31. Such a flame carryover construction is not suitable for low $NO_x$, lean pre-mix burners designed to meet the more stringent $NO_x$ regulations of the future.

Figure 3:
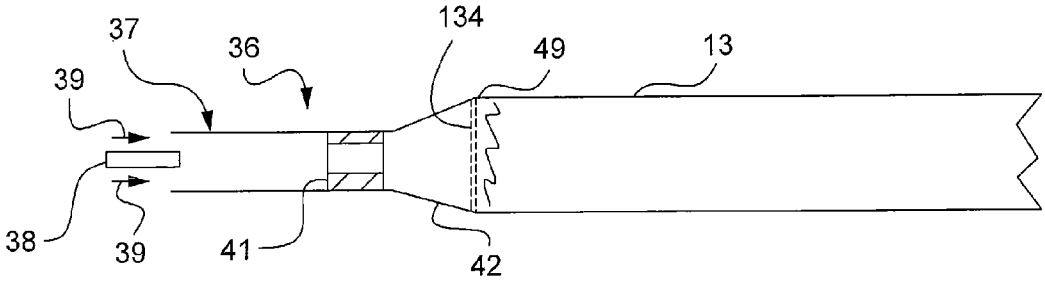
FIG. 3 is side view of a prior art lean pre-mix burner and flame retention device that are coupled to a heat exchanger section.

For example, turning to FIG. 3, a lean pre-mix burner 36 is illustrated as coupled to a primary heat exchanger section 13. The burner 36 includes a burner tube 37 and a fuel nozzle 38. Air is drawn into the burner to 37 under the pull of the inducer fan 23 (FIG. 1) as indicated by the arrows 39. A flame retention device 134 is illustrated at the junction between the heat exchanger section 13 and the burner tube 37. The burner tube 37 may also include a mixer 41, which is used to decrease lean blow-off and increase the stability of the flame. The burner tube 37 includes an outlet section 42 that is coupled to the inlet 49 of the heat exchanger section 13.

Figure 4:
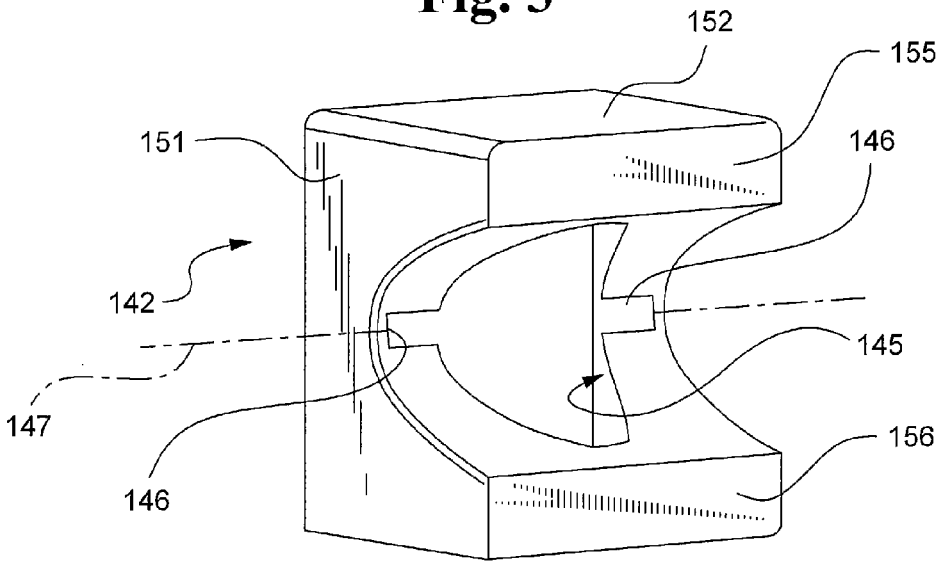
FIG. 4 is a front perspective view of an outlet for a disclosed pre-mix, low $NO_x$ burner that includes an integrated flame carryover mechanism.
Figure 5:
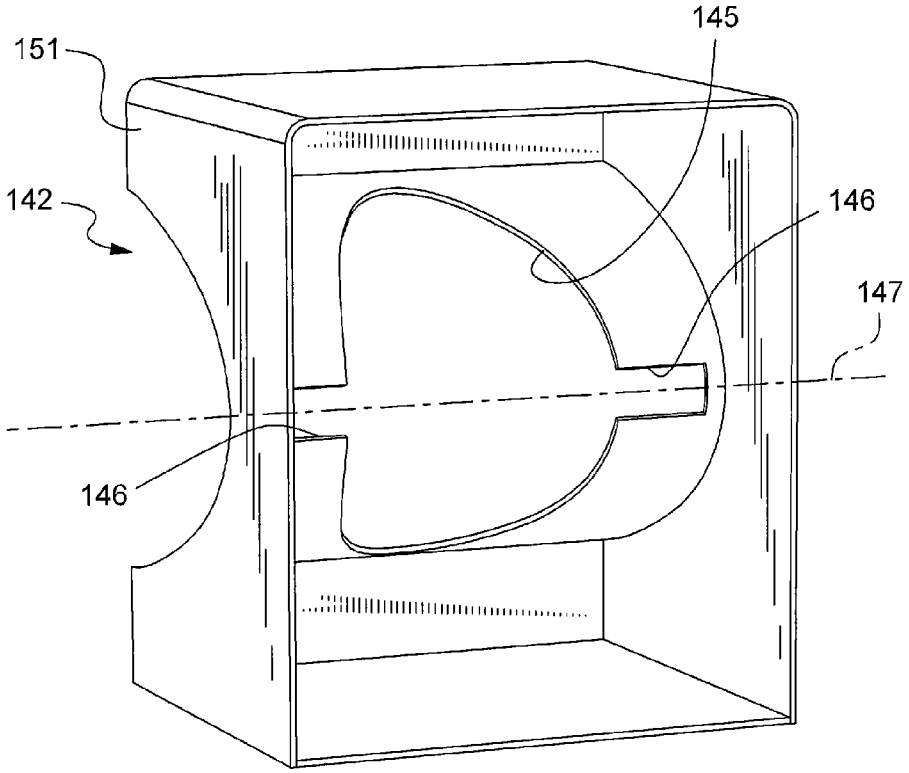
FIG. 5 is a rear perspective view of the burner outlet illustrated in FIG. 4.
Figure 6:
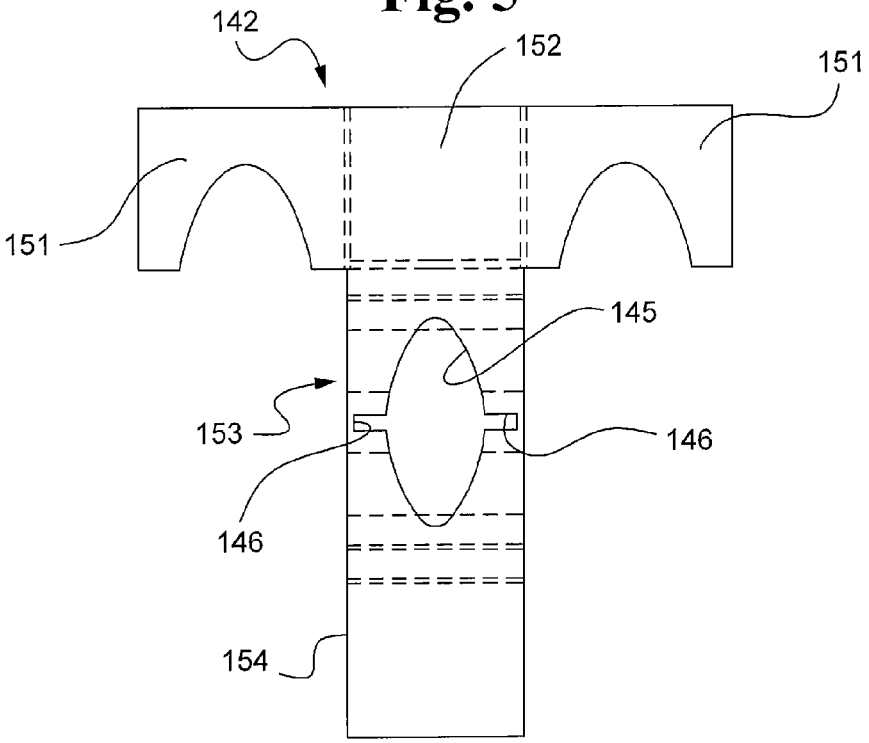
FIG. 6 is a top plan view of a piece of sheet metal cut to form the burner outlet illustrated in FIGS. 4-5.
Figure 7:
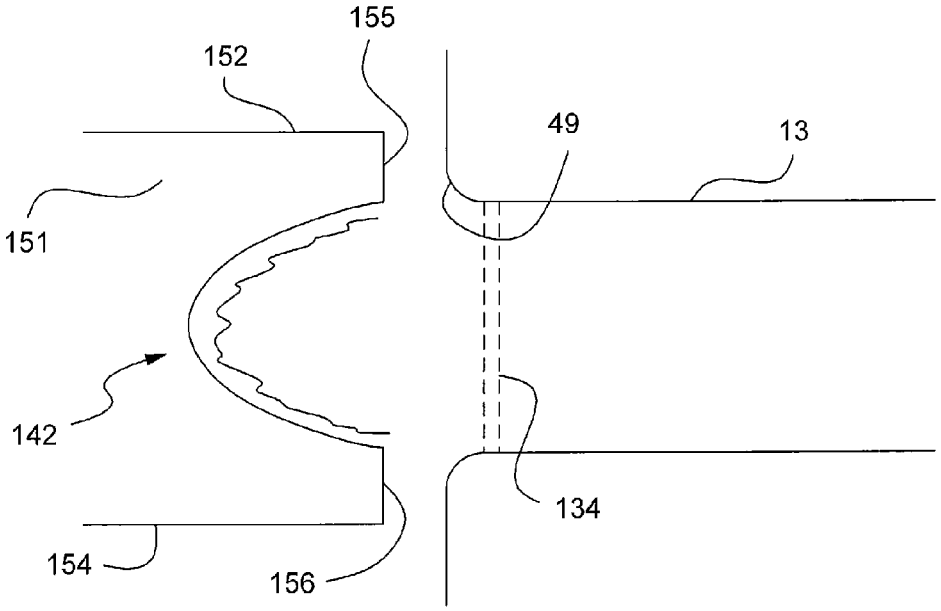
FIG. 7 is a side plan view illustrating the coupling of a disclosed burner outlet to a sectional heat exchanger.
Figure 8:
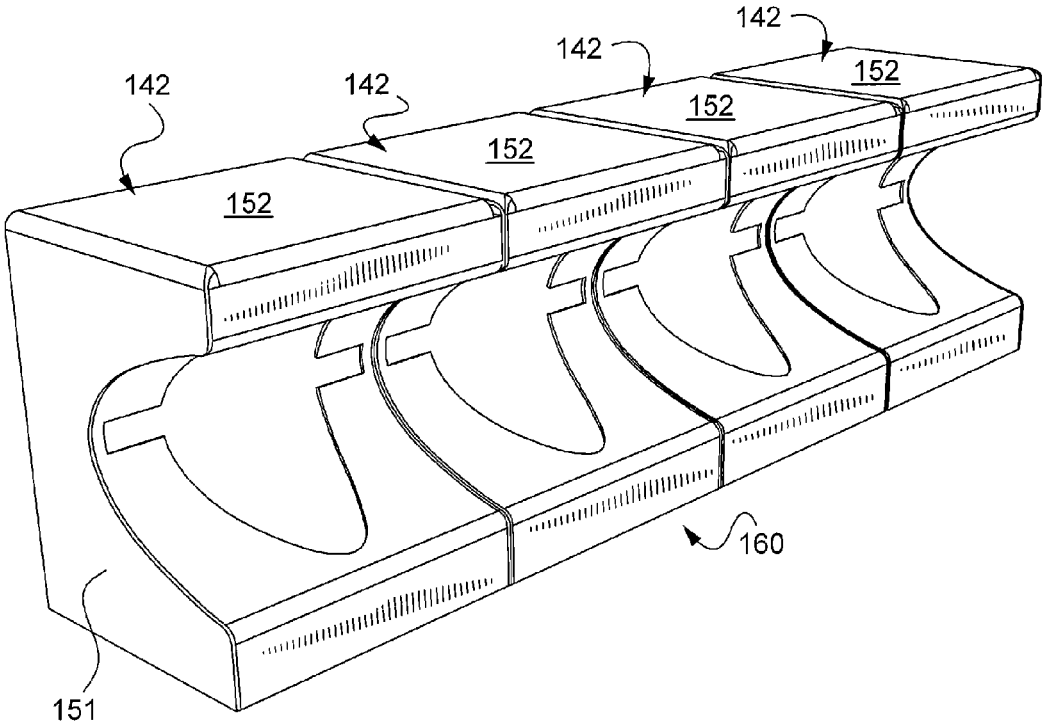
FIG. 8 is a partial perspective view of a disclosed burner assembly illustrating the flame carryover mechanism.

An improved outlet section 142 is provided as illustrated in FIGS. 4-5. Turning to FIG. 4, the outlet section 142 includes an elliptical primary outlet opening 145 that includes a pair of outwardly extending transverse slots 146 that extend along a minor access 147 of the elliptical opening 145. FIG. 6 provide a top plan view of a for fabricating the burner outlet 142 from a single piece of sheet metal. Specifically, the side panels 151 are connected to a top panel 152 which, in turn, is connected to a front panel 153 which includes the elliptical primary outlet 145 and transverse slots 146. The front panel 153 is connected to a bottom panel 154. The two front walls 155, 156 may be connected to the inlet 49 of a heat exchanger section 13 as illustrated in FIG. 7. The sidewalls 151 may be connected to a joining sidewalls of other burner outlets to form a burner assembly 160 as illustrated in FIG. 8.

Because the flame retainer device 134 can provide a complex flow field that allows the flame to anchor to it, mesh burners like those shown at 36 in FIG. 3 are typically used in single burner applications and are designed in such a fashion to provide a continuous burner surface. Sectional gas furnaces use multiple heat exchangers each with an individual burner. Therefore, applying a continuous burner between multiple heat exchangers will over temp both the inlet to the heat exchangers and the area between heat exchangers of the panel that the heat exchangers are mounted to. Creating a zone of lower energy release between burners as illustrated in FIGS. 4-8 will mitigate over temping while allowing a semi-continuous combustion surface for multi-burner ignition (FIG. 8).

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A burner assembly comprising:

a first burner comprising a first burner tube that receives a mixture of fuel and air, the first burner tube coupled to a first outlet;

a second burner comprising a second burner tube that receives a mixture of fuel and air, the second burner tube coupled to a second outlet;

the first outlet having rectilinear front walls, a first side wall and a trough formed between the front walls by a concave outer face, the first outlet comprising a primary outlet opening formed in the concave outer face of the first outlet, the primary outlet opening defining a first transverse slot for communicating a flame to the second outlet;

the second outlet having rectilinear front walls, a second side wall and a trough formed between the front walls by a concave outer face, the second outlet comprising a second primary outlet opening formed in the concave outer face of the second outlet, the second primary outlet opening defining a second transverse slot for receiving a flame from the first outlet;

the first transverse slot aligned with the second transverse slot, the first side wall adjoining the second side wall, the first side wall contacting the second side wall.

2. The burner assembly of claim 1 wherein each transverse slot extends from its respective primary outlet opening and terminates short of the outlet of the adjacent burner.

3. The burner assembly of claim 1 wherein each primary outlet opening is formed in a shape of an ellipse and each transverse slot is disposed along a semi-minor axis of the ellipse.

4. The burner assembly of claim 1 wherein each primary outlet opening is formed in a shape of an ellipse and each outlet further comprises a pair of oppositely directed transverse slots extending outward from their respective primary outlet opening along a semi-minor axis of the ellipse.

5. The burner assembly of claim 1 wherein each primary outlet opening is elliptical.

6. The burner assembly of claim 1 wherein only one of the first burner and second burner is coupled to an igniter.

7. A low $NO_x$ furnace, comprising the burner assembly of claim 1.

8. The furnace of claim 7, wherein the front walls are configured to connect to an inlet of a heat exchanger section.

* * * * *